US012583640B2

(12) United States Patent
Schwinn et al.

(10) Patent No.: US 12,583,640 B2
(45) Date of Patent: Mar. 24, 2026

(54) AUTOMATIC BUNDLING TOOL DEVICE WITH GUIDING UNIT FOR DEFORMED AND/OR LOOSE ONE-PIECE TIES

(71) Applicant: HellermannTyton GmbH & Co. KG, Tornesch (DE)

(72) Inventors: Andreas Schwinn, Tornesch (DE); Taro David Fukuda, Rastede (DE)

(73) Assignee: HELLERMANNTYTON GmbH, Tornesch (DE)

( * ) Notice: Subject to any disclaimer, the term of this patent is extended or adjusted under 35 U.S.C. 154(b) by 242 days.

(21) Appl. No.: 18/481,828

(22) Filed: Oct. 5, 2023

(65) Prior Publication Data

US 2024/0116661 A1 Apr. 11, 2024

(30) Foreign Application Priority Data

Oct. 6, 2022 (DE) ..... 202022002179.8

(51) Int. Cl.
*B65B 13/04* (2006.01)
*B65B 13/18* (2006.01)
*B65B 13/22* (2006.01)

(52) U.S. Cl.
CPC ..... *B65B 13/04* (2013.01); *B65B 13/185* (2013.01); *B65B 13/22* (2013.01)

(58) Field of Classification Search
CPC ..... B65B 13/04; B65B 13/185; B65B 13/22; B65B 13/02; B65B 13/027; B65B 13/18; B65B 13/08; B65B 27/10; B65D 63/16
See application file for complete search history.

(56) References Cited

U.S. PATENT DOCUMENTS 3,865,156 A 2/1975 Moody et al.
4,178,973 A * 12/1979 Collier ..... B65B 13/027 140/93.2
4,371,010 A 2/1983 Hidassy
4,495,972 A 1/1985 Walker
4,516,488 A 5/1985 Bartzick et al.
4,534,817 A 8/1985 O'Sullivan
4,790,225 A 12/1988 Moody et al.
(Continued)

FOREIGN PATENT DOCUMENTS

CN 1100054 3/1995
CN 1572657 2/2005
(Continued)

OTHER PUBLICATIONS

"Extended European Search Report", EP Application No. 23201566.9, Apr. 25, 2024, 6 pages.
(Continued)

*Primary Examiner* — Jimmy T Nguyen
(74) *Attorney, Agent, or Firm* — Colby Nipper PLLC

(57) ABSTRACT

An automatic bundling tool device (ABT) for bundling a bundling good via a one-piece-tie (OPT). In aspects, an ABT includes a holding unit configured to receive, hold, and release a respective OPT; a motion guiding unit configured to guide a motion of the holding unit between a receiving position and a releasing position; a claw unit configured to guide a strap of the respective OPT around the bundling good; and a tip guiding unit with at least one guiding flap element configured to guide a tip of the respective OPT towards an entrance of the claw unit.

14 Claims, 3 Drawing Sheets

(56) References Cited

U.S. PATENT DOCUMENTS

| | | | |
|---|---|---|---|
| 4,793,385 | A | 12/1988 | Dyer et al. |
| D306,390 | S | 3/1990 | Dyer |
| 4,997,011 | A | 3/1991 | Dyer et al. |
| 5,205,328 | A | 4/1993 | Johnson |
| 5,287,802 | A | 2/1994 | Pearson |
| 5,417,252 | A | 5/1995 | Kurmis |
| 5,492,156 | A | 2/1996 | Dyer et al. |
| 5,595,220 | A | 1/1997 | Leban et al. |
| 5,769,133 | A | 6/1998 | Dyer et al. |
| 5,809,873 | A | 9/1998 | Chak et al. |
| 5,845,681 | A | 12/1998 | Kurmis |
| 5,909,751 | A | 6/1999 | Teagno |
| 5,915,425 | A | 6/1999 | Nilsson et al. |
| 5,921,290 | A | 7/1999 | Dyer et al. |
| D430,781 | S | 9/2000 | Hillegonds |
| 6,119,734 | A | 9/2000 | Kurmis |
| 6,206,053 | B1 | 3/2001 | Hillegonds |
| 6,302,157 | B1 | 10/2001 | Deschenes et al. |
| 6,354,336 | B1 | 3/2002 | Leban |
| 6,401,766 | B1 | 6/2002 | Ishikawa |
| 6,497,258 | B1 | 12/2002 | Flannery et al. |
| D473,773 | S | 4/2003 | Hillegonds et al. |
| 6,543,341 | B2 | 4/2003 | Lopez |
| D491,430 | S | 6/2004 | Magno et al. |
| 6,751,828 | B2 | 6/2004 | Matschiner et al. |
| 6,840,289 | B2 | 1/2005 | Hillegonds |
| D510,244 | S | 10/2005 | Magno et al. |
| 6,981,528 | B2 | 1/2006 | Bartholomew |
| 7,124,787 | B2 | 10/2006 | Lueschen |
| 7,165,379 | B1 | 1/2007 | Lai |
| 7,210,506 | B2 | 5/2007 | Magno |
| 7,216,679 | B2 | 5/2007 | Magno et al. |
| D543,811 | S | 6/2007 | Lueschen |
| 7,231,944 | B2 | 6/2007 | Magno et al. |
| D547,626 | S | 7/2007 | Lueschen et al. |
| 7,299,830 | B2 | 11/2007 | Levin et al. |
| 7,422,037 | B2 | 9/2008 | Levin et al. |
| 7,591,451 | B2 | 9/2009 | Dyer et al. |
| 8,240,343 | B2 | 8/2012 | Dyer et al. |
| D692,738 | S | 11/2013 | Dyer |
| 8,955,556 | B2 | 2/2015 | Myers et al. |
| 8,960,241 | B2 | 2/2015 | Dyer |
| D732,361 | S | 6/2015 | Dyer |
| D755,029 | S | 5/2016 | Myers et al. |
| D758,155 | S | 6/2016 | Kruzel |
| 9,394,067 | B2 | 7/2016 | Dyer |
| 9,394,068 | B2 | 7/2016 | Dyer |
| 9,481,102 | B1 | 11/2016 | Hojnacki et al. |
| 9,550,590 | B2 | 1/2017 | Dyer |
| 9,586,708 | B2 | 3/2017 | Finzo |
| 9,694,924 | B2 | 7/2017 | Myers et al. |
| 9,701,428 | B2 | 7/2017 | Welby et al. |
| D818,787 | S | 5/2018 | Kitago |
| 10,259,604 | B2 | 4/2019 | Myers |
| D856,101 | S | 8/2019 | Kitago |
| D878,177 | S | 3/2020 | Kitago |
| D885,861 | S | 6/2020 | Ni |
| 11,008,123 | B2 | 5/2021 | Kitago |
| 11,008,124 | B2 | 5/2021 | Kitago |
| 11,027,902 | B2 | 6/2021 | Geiger et al. |
| 11,377,241 | B2 | 7/2022 | Itatools et al. |
| 11,511,894 | B2 | 11/2022 | Hempe et al. |
| 12,258,155 | B2 | 3/2025 | Fukuda et al. |
| 2002/0093211 | A1 | 7/2002 | Filipiak et al. |
| 2002/0108664 | A1 | 8/2002 | Kurmis |
| 2002/0108665 | A1 | 8/2002 | Thieme |
| 2002/0108666 | A1 | 8/2002 | Kurmis |
| 2002/0108667 | A1 | 8/2002 | Thieme |
| 2002/0108668 | A1 | 8/2002 | Thieme |
| 2002/0129866 | A1 | 9/2002 | Czebatul et al. |
| 2003/0136278 | A1 | 7/2003 | Miyazaki et al. |
| 2004/0079436 | A1 | 4/2004 | Hillegonds |
| 2004/0244606 | A1 | 12/2004 | Haberstroh et al. |
| 2004/0244866 | A1 | 12/2004 | Ishikawa et al. |
| 2005/0178460 | A1 | 8/2005 | Magno |
| 2005/0178461 | A1 | 8/2005 | Magno et al. |
| 2006/0011254 | A1 | 1/2006 | Yokochi et al. |
| 2006/0037661 | A1 | 2/2006 | Lueschen |
| 2007/0157555 | A1 | 7/2007 | Tanner |
| 2007/0199610 | A1 | 8/2007 | Itagaki |
| 2009/0121069 | A1 | 5/2009 | Dyer et al. |
| 2013/0167969 | A1 | 7/2013 | Myers et al. |
| 2013/0167970 | A1 | 7/2013 | Dyer |
| 2015/0053300 | A1 | 2/2015 | Myers et al. |
| 2015/0151862 | A1 | 6/2015 | Kitago |
| 2015/0239588 | A1 | 8/2015 | Kitago |
| 2016/0016682 | A1 | 1/2016 | Boss et al. |
| 2016/0046398 | A1 | 2/2016 | Neeser et al. |
| 2016/0075456 | A1 | 3/2016 | Nomura et al. |
| 2016/0167813 | A1 | 6/2016 | Myers |
| 2016/0230907 | A1 | 8/2016 | Kitago |
| 2016/0280405 | A1 | 9/2016 | Thieme et al. |
| 2017/0057674 | A1 | 3/2017 | Myers |
| 2017/0174374 | A1 | 6/2017 | Figiel et al. |
| 2017/0334587 | A1 | 11/2017 | McFall et al. |
| 2019/0106231 | A1 | 4/2019 | Schwinn et al. |
| 2019/0127095 | A1 | 5/2019 | Kitago |
| 2019/0144149 | A1 | 5/2019 | Dohrmann et al. |
| 2019/0210749 | A1 | 7/2019 | Kitago |
| 2019/0248521 | A1 | 8/2019 | Hillegonds et al. |
| 2020/0391891 | A1 | 12/2020 | Xu |
| 2021/0024235 | A1 | 1/2021 | Xu |
| 2021/0094713 | A1 | 4/2021 | Hempe et al. |
| 2023/0060775 | A1 | 3/2023 | Hempe et al. |
| 2023/0104154 | A1 | 4/2023 | Fukuda et al. |
| 2023/0128208 | A1 | 4/2023 | Dyer |
| 2023/0331412 | A1 | 10/2023 | Fukuda et al. |

FOREIGN PATENT DOCUMENTS

| | | | |
|---|---|---|---|
| CN | 1660675 | | 8/2005 |
| CN | 101486385 | | 7/2009 |
| CN | 101585419 | | 11/2009 |
| CN | 101983159 | | 3/2011 |
| CN | 102275649 | A | 12/2011 |
| CN | 102859821 | | 1/2013 |
| CN | 202670128 | | 1/2013 |
| CN | 104870315 | | 8/2015 |
| CN | 105059581 | | 11/2015 |
| CN | 105916774 | A | 8/2016 |
| CN | 106742178 | | 5/2017 |
| CN | 206579887 | | 10/2017 |
| CN | 108791998 | | 11/2018 |
| CN | 109250221 | A | 1/2019 |
| CN | 112550799 | | 3/2021 |
| CN | 112660456 | A | 4/2021 |
| DE | 29617650 | | 2/1998 |
| DE | 69728071 | | 2/2005 |
| DE | 102013222924 | | 5/2015 |
| DE | 102014103334 | | 9/2015 |
| DE | 112013000471 | | 4/2016 |
| EP | 0722885 | | 7/1996 |
| EP | 0839717 | | 5/1998 |
| EP | 1564146 | | 8/2005 |
| EP | 3068693 | | 1/2019 |
| EP | 3666671 | | 6/2020 |
| EP | 3712076 | | 9/2020 |
| EP | 3466819 | | 11/2020 |
| EP | 3483075 | | 12/2020 |
| EP | 3747781 | | 12/2020 |
| GB | 885371 | | 12/1961 |
| JP | H09110010 | | 4/1997 |
| JP | H09240617 | | 9/1997 |
| JP | 2000103407 | | 4/2000 |
| JP | 2016537272 | | 12/2016 |
| KR | 102267779 | | 6/2021 |
| WO | 9815458 | | 4/1998 |

(56) References Cited

FOREIGN PATENT DOCUMENTS

| | | |
|---|---|---|
| WO | 2009152707 | 12/2009 |
| WO | 2015067444 | 5/2015 |

OTHER PUBLICATIONS

"Autotool 2000 CPK Operating Instructions", Hellerman Tyton, 106-29006, Apr. 2, 2015, 29 pages.
"Extended European Search Report", EP Application No. 20198300.4, May 20, 2021, 11 pages.
"Extended European Search Report", EP Application No. 18192166.9, Jan. 15, 2019, 5 pages.
"Extended European Search Report", EP Application No. 22198311.7, Mar. 13, 2023, 8 pages.
"Final Office Action", U.S. Appl. No. 16/120,926, filed Feb. 17, 2022, 13 pages.
"Final Office Action", U.S. Appl. No. 16/120,926, filed Nov. 15, 2021, 18 pages.
"Foreign Office Action", CN Application No. 201811167015.1, Dec. 11, 2020, 14 pages.
"Foreign Office Action", CN Application No. 201811344796.7, Jun. 28, 2020, 17 pages.
"Foreign Office Action", CN Application No. 201811167015.1, Apr. 24, 2020, 18 pages.
"Foreign Office Action", CN Application No. 202011032227.6, Dec. 16, 2021, 23 pages.
"Foreign Office Action", CN Application No. 202011032227.6, Jun. 7, 2022, 55 pages.
"Foreign Office Action", CN Application No. 202011032227.6, Jun. 7, 2022, 58 pages.
"Foreign Office Action", CN Application No. 201811344796.7, Jan. 26, 2021, 7 pages.
"Foreign Office Action", CN Application No. 201811167015.1, Jun. 2, 2021, 7 pages.
"Foreign Office Action", CN Application No. 202011032227.6, Nov. 3, 2022, 7 pages.
"Non-Final Office Action", U.S. Appl. No. 16/120,926, filed May 27, 2020, 13 pages.
"Non-Final Office Action", U.S. Appl. No. 16/163,677, filed Jun. 1, 2020, 14 pages.
"Non-Final Office Action", U.S. Appl. No. 16/163,677, filed Jun. 10, 2022, 15 pages.
"Non-Final Office Action", U.S. Appl. No. 16/163,677, filed Dec. 7, 2021, 19 pages.
"Non-Final Office Action", U.S. Appl. No. 17/009,628, filed Nov. 29, 2021, 20 pages.
"Non-Final Office Action", U.S. Appl. No. 17/009,628, filed Mar. 11, 2022, 23 pages.
"Non-Final Office Action", U.S. Appl. No. 29/812,879, filed May 8, 2023, 5 pages.
"Non-Final Office Action", U.S. Appl. No. 18/049,821, filed Mar. 31, 2023, 9 pages.
"Notice of Allowance", U.S. Appl. No. 16/163,677, filed Aug. 25, 2022, 11 pages.
"Notice of Allowance", U.S. Appl. No. 29/812,879, filed Aug. 17, 2023, 6 pages.
"Notice of Allowance", U.S. Appl. No. 17/009,628, filed Jul. 29, 2022, 8 pages.
"Notice of Allowance", U.S. Appl. No. 18/049,821, filed Aug. 9, 2023, 8 pages.
"Partial European Search Report", EP Application No. 20198300.4, Feb. 18, 2021, 12 pages.
"Today's Mechanisms Mini Test", 4CR—Technological Studies—Retrieved at: gwcts3.blogspot.com/2011/09/todays-mechanisms-mini-test.html—on Nov. 19, 2021, Sep. 16, 2011, 3 pages.
HELLERMANTYTON , "EVO 7 Series & 7i Series Nosepiece, 1/Pkg", Retrieved at: https://www.hellermanntyton.us/products/110-70011/—on Mar. 30, 2022, 1 page.
HELLERMANTYTON , "EVO 7 Series & 7i Series Nosepiece, 1mm tail, 1/pkg", Retrieved at: https://www.hellermanntyton.us/products/110-70131/—on Mar. 30, 2022, 1 page.
HELLERMANTYTON , "EVO 7 Series & 7i Series Nosepiece, 2mm tail, 1/pkg", Retrieved at: https://www.hellermanntyton.us/products/110-70132/—on Mar. 30, 2022, 1 page.
HELLERMANTYTON , "EVO 7 Series & 7i Series Nosepiece, 3mm tail, 1/pkg", Retrieved at: https://www.hellermanntyton.us/products/110-70133/—on Mar. 30, 2022, 1 page.
HELLERMANTYTON , "EVO 9 and EVO 9i 2mm Nosepiece, Extended Tail, 1/pkg", Retrieved at: https://www.hellermanntyton.us/products/110-80064/—on Mar. 30, 2022, 1 page.
HELLERMANTYTON , "EVO 9 and EVO 9i 3mm Nosepiece, Extended Tail, 1/pkg", Retrieved at: https://www.hellermanntyton.us/products/110-80065/—on Mar. 30, 2022, 1 page.
HELLERMANTYTON , "EVO 9 and EVO 9i 4mm Nosepiece, Extended Tail, 1/pkg", Retrieved at: https://www.hellermanntyton.us/products/110-80066/—on Mar. 30, 2022, 1 page.
HELLERMANTYTON , "EVO 9 and EVO 9i 5mm Nosepiece, Extended Tail, 1/pkg", Retrieved at: https://www.hellermanntyton.us/products/110-80067/—on Mar. 30, 2022, 1 page.
HELLERMANTYTON , "EVO 9 Nosepiece Flush Cut, Replacement Part, 1/pkg", Retrieved at: https://www.hellermanntyton.us/products/110-80018/—on Mar. 30, 2022, 1 page.
Pishehvari, Bergische , et al., "Ego-pose estimation via Radar and Openstreetmap-based Scan matching", May 2018, 8 pages.
"Non-Final Office Action", U.S. Appl. No. 17/936,690, filed Sep. 6, 2024, 11 pages.
"Notice of Allowance", U.S. Appl. No. 17/936,690, filed Nov. 27, 2024, 7 pages.
"Foreign Office Action", CN Application No. 202310403137.0, Jul. 15, 2025, 11 pages.
"Restriction Requirement", U.S. Appl. No. 18/299,477, filed Aug. 6, 2025, 6 pages.
"Ex Parte Quayle", U.S. Appl. No. 18/299,477, Jan. 20, 2026, 12 pages.
"Foreign Office Action", CN Application No. 202311301899.6, Jan. 14, 2026, 13 pages.

* cited by examiner

AUTOMATIC BUNDLING TOOL DEVICE WITH GUIDING UNIT FOR DEFORMED AND/OR LOOSE ONE-PIECE TIES

INCORPORATION BY REFERENCE

This application claims priority to German Patent Application No. DE202022002179.8, filed Oct. 6, 2022, the disclosure of which is incorporated by reference in its entirety.

BACKGROUND

In an automatic bundling tool device, usually a cable tie, or, more generally, and one-piece tie, is being guided in a set of claw or jaw elements of a claw unit around a bundling good until a loop is created around the bundling good by the one-piece tie. The tip of the one-piece tie is arranged, in a longitudinal direction, in front of the one-piece tie head part, and is then pushed along the guiding jaw elements through an opening, a window, in the head part to close the loop. Then, a tensioning or tightening system grips a strap part of the one-piece tie and tensions or tightens the bundle. One possibility for transporting one-piece ties in automatic bundling tool devices is the use of a mechanical slider which is incorporating a holding fixture that holds the one-piece fixing tie by its head, thus implementing a movable holding unit for the one-piece tie. This slider can be driven in a longitudinal direction to move the one-piece tie forward towards the bundling good and is usually designed for holding one specific given type of one-piece tie (OPT). Such a solution is shown in EP 18 903 233 A1.

Alternative approaches rely on pneumatics or on mechanical guidance realised by a bandoleer to which the cable ties are pre-attached to. Compare e.g. EP 19 747 727 A1 or EP 3 712 076 A1.

All known approaches share the common problem that the reliability of the automatic bundling tool device depends strongly on the correct shape of the one-piece tie, that is, on the straightness of the strap or tail of the one-piece tie. In particular this hinders the use of loose one-piece ties, preferably loose cable ties as one-piece ties.

SUMMARY

The disclosure relates to an automatic bundling tool device (ABT) for bundling a bundling good by means of a one-piece tie (OPT), in particular by means of a cable tie, preferably a loose cable tie. The automatic bundling tool device comprises a holding unit configured to receive, hold, and release a respective one-piece tie which is provided to the automatic bundling tool device from an external reservoir of one-piece ties, a motion guiding unit configured to guide a motion of the holding unit between a receiving position of the holding unit, where the holding unit receives, during intended use, the respective one-piece tie and a releasing position of the holding unit, where the holding unit releases, during intended use, the respective one-piece tie, as well as a claw unit configured to guide, during intended use, a strap or tail of the respective one-piece tie around the bundling good.

The problem to be solved by the invention at hand can thus be regarded as to provide an improved automatic bundling tool device, which can process one-piece ties with deformed, that is, non-straight straps reliably, in particular more reliably than existing solutions.

This problem is solved by the independent claims. Advantageous embodiments are apparent from the dependent claims, the description, and the figures.

One aspect relates to an automatic bundling tool device, ABT, for bundling a bundling good by means of a one-piece tie, OPT, preferably with automatically tightening the OPT by the ABT. In particular, the ABT is configured for bundling the bundling good by means of a cable tie as OPT, preferably with automatically tightening the cable tied by the ABT. The ABT may be a non-stationary ABT. The one-piece tie may be a loose one-piece tie or a loose cable tie, as usually sold in bags or sacks.

Generally, OPTs, as a generalised concept of a standard cable tie which has a cable tie head (part) with a window, as well as a cable tie strap (part) or tail (part), which is slid through the window in order to form a loop which can be used to bundle cables and alike, also comprises a neck (part), which connects a foot (part) to the head (part). The foot part comprises some sort of fixing means, for instant as an arrowhead (also referred to as fir tree), that can be used to fix the OPT to an object, for instance a hole in the object. OPTs may belong to one or more given types, where the OPTs belonging to different types differ in foot part geometry or shape and/or neck part geometry or shape and/or head part geometry or shape and/or tail part geometry or shape, in particular tail part length and/or tail part thickness and/or tail part broadness.

The ABT described here comprises a holding unit configured to receive, hold, and release a respective OPT, which is provided to the ABT from an external reservoir of OPTs. The ABT further comprises a motion guiding unit configured to guide a motion of the holding unit back and forth between a receiving position of the holding unit, where the holding unit receives, during intended use, the respective OPT that is processed by the ABT at the time, and a releasing position of the holding unit, where the holding unit releases, during intended use, said OPT. The motion guiding unit preferably is a linear motion guiding unit which is configured to linearly guide said holding unit in a longitudinal direction while in motion back and forth between said receiving position and said releasing position. The longitudinal direction corresponds to a main extension direction of the OPT held by the holding unit, with the tip of the OPT orientated in a forward direction from the receiving position to the releasing position, and the head part of the OPT orientated in a rearward direction opposite to the forward direction. This definition applies to an ideal OPT, e.g., a non-deformed OPT with straight strap part. The motion guiding unit or linear motion guiding unit enables low friction guiding of the holding unit and allows for high processing speeds. Furthermore, the ABT may comprise a drive unit configured to move the holding unit along the motion guiding unit or linear motion guiding unit. The motion guiding unit may comprise corresponding rail elements that run in parallel to the longitudinal direction.

The holding unit may comprise two gripping elements which are arranged movably on a common base element such that they can be moved in a lateral direction running traverse to the longitudinal direction. Here and in the following, "traverse" may refer to "essentially perpendicular", e.g., "perpendicular" or "perpendicular with a given deviation". A deviation generally may be, for instance less than 5°, less than 2°, or less than 1°. Each gripping element may have a respective gripping contour for accommodating the respective OPT to be received, held, and released during intended use of the ABT. The contour is then specifically adapted to the respective OPTs to be processed by the ABT.

Each gripping element may be configured to be moved from an open position for receiving and releasing the respective OPT to a closed position for holding the respective OPT and vice versa. In the open position, a distance between the two gripping elements is larger than in a closed position. Thus, the OPT can be placed in/removed from between the gripping elements. The contours may, at least partly, surround head part and/or neck part and/or foot part of the respective OPT in the closed position to hold the OPT with the holding unit, in particular in a form-fit manner.

Preferably, in both releasing and receiving position of the holding unit, the holding unit may be set into a locked configuration with the gripping elements in the closed position and into an unlocked configuration, where the gripping elements are in the open position. This enables the ABT to process different types of OPTs, in particular also OPT so loose cable ties. In particular, the ABT may comprise all features of the ABT of the German Utility Model DE 20 2021 105 773 U, which is hereby incorporated in its entirety by reference.

Furthermore, the ABT comprises a claw unit configured to guide, during intended use, a strap or tail of the respective OPT around the bundling good. Therein, the claw unit may comprise a first claw or jaw element which is a stationary claw element, and a second claw or jaw element which is a movable claw element. Here and in the following, stationary and movable may refer to a movement relative to the motion guiding unit and/or a housing of the ABT and/or a handle of the ABT.

The ABT further comprises a tip guiding unit which may also be referred to as baffle unit with at least one guiding flap element (preferably only one guiding flap element), which may also be referred to as baffle plate element. The tip guiding unit is configured to guide or deflect a tip of the respective OPT towards or through an entrance or inlet of the claw unit when the respective OPT is moved towards the releasing position of the holding unit by the holding unit moving forwards, that is, from the receiving position to the releasing position. This is done such that also deformed or bent OPTs, that is, OPTs with a deformed or bent strap, where the tip part is laterally shifted away from an OPT track which is determined by the movement of the holding unit, are moved correctly into the claw unit by the holding unit. In other words, the guiding flap is configured to temporarily straighten deformed or bent OPTs such that their tips are moved to and through said entrance or inlet of the claw unit as if they were ideal (e.g., straight) OPTs. The guiding flap element may be a movable guiding flap or static guiding flap element, as described in more detail in the below.

In addition to the guiding flap element of the tip guiding unit, there may be an additional static guiding structure of the claw unit, which is not part of the tip guiding unit, and that comprises a set of two or more converging surfaces which make it simpler to lead the strap of the OPT into the claw unit. Said at least two surfaces converging in the forward direction may indeed form said entrance or inlet of the claw unit. For instance, said surfaces may transition into walls and/or bottom of an OPT channel in one of the claw or jaw elements which is used to guide the strap of the OPT around the bundle good.

This gives the advantage that the tip of deformed or bent OPTs is automatically aligned with the entrance of the claw unit, thus overcoming the problem of misguided OPT straps which otherwise lead to failure of the bundling process. As a consequence, the requirements for the OPTs processed are decreasing with respect to the straightness of the straps. This leads to the advantage that the automatic bundling tool device described here is capable of processing lose OPTs, in particular loose cable ties, which have a significant probability of being bent, without increasing failure rate. As loose cable ties are cheaper than, for instance cable ties provided in form of a bandoleer, this also gives economic advantages. Furthermore, as loose cable ties can be refilled during the bundling process more easily than an empty bandoleer can be replaced by a new bandolier, an increase processing speed may be achieved.

In an advantageous embodiment, at least one distance (e.g., one or more distances) between the at least one guiding flap element and the OPT track along which the respective OPT is moved from receiving position to releasing position by the motion guiding unit and/or the holding unit is decreasing in a direction towards the claw unit. So, the distance is decreasing with increasing proximity to the claw unit. The distance is measured in a direction perpendicular to the track, at several respective positions along the track. Preferably an end of the at least one guiding flap element proximal to the claw unit, a proximal end, is forming a gate or a part of the gate that guides the tip (in)to the entrance of the claw unit. Consequently, the OPT track runs parallel to the strap of an ideal (e.g., straight) OPT processed by the ABT. Thus, the at least one guiding flap element and the OPT track are converging such that the at least one guiding flap element directs or deflects the OPT straps towards the OPT track and thus, while the OPT is moved in the longitudinal direction by the holding unit, towards the entrance of the claw unit. The at least one guiding flap element may also, as also apparent from the explanations provided below, itself comprise converging (inner side) surfaces that guide said tip and thus strap of the OPT towards the entrance of the claw unit. The respective converging (side) surfaces may be formed by one single guiding flap element, or more guiding flap elements, preferably exactly two guiding flap elements. The respective converging (inner side) surfaces may enclose an angle of preferably less than 90°. In particular, an angle between the OPT track and a (inner top) surface of the at least one guiding flap element configured to deflect straps that are bent in an upward direction (thickness direction of the OPT) may be less than 50°. This gives the advantage that the movement of the OPT in the forward direction, which is required and thus implemented anyway, is used to straighten the strap such that it can be threaded into the claw unit reliably without additional actuator.

In a particular advantageous embodiment, the at least one distance is measured perpendicular to the OPT track as a y-distance in a direction of thickness of the respective OTP (an upwards direction), where the OPT is considered to be an ideal (=straight) OPT for the measurement. Preferably, the at least one distance is measured comprising two distances perpendicular to the tracks, as a y-distance in a direction of thickness of the respective OPT and, in addition, as a z-distance in a direction of width of the respective OPT (a sidewards direction running traverse to the upward direction). Therein, depending on the shape of the at least one guiding flap element, one single guiding flap element may implement the decreasing y-distance by an upper inner (deflecting) surface, or the decreasing y-distance by an upper inner (deflecting) surface and the z-distances by two converging side inner (deflecting) surfaces. Alternatively, several, preferably precisely two guiding flap elements may implement said one or more distances. Therein, the y-distances preferably cover a greater range than the z-distances, meaning that the biggest (maximal) y-distance may be greater than the biggest (maximal) z-distance. The y-distances comprise a maximal y-distance which may be greater than 10 mm, preferably greater than 19 mm. The z-di stances comprise a maximal z-distance which may be greater than 8 mm, preferably greater than 16 mm. This gives the advantage that bent OPTs can be directed to the entrance of the claw unit with increased reliability, as OPTs, in particular loose OPTs, tend to be bent in the direction of thickness of the OPT, as their direction of thickness corresponds to the plane in which they form the loop to bundle the respective bundle good. Consequently, in the direction of width, less deviation of the straps from the ideal straight OPT strap is to be expected.

Consequently, the at least one guiding flap elements may form a section of a funnel narrowing towards the claw unit, where the narrow (proximal) end shapes a gate or part of a gate that is configured to guide the tip into the entrance of the claw unit. This section preferably covers more than 180° in a circumferential direction around the OPT track in a plane perpendicular to the OPT track. As also shown in the figures, the at least one guiding flap element may mainly extend in the main extension of the straight OPT track, e.g., an x-direction (in particular when the guiding flap element is in a guiding position). This gives the advantage that a large variety of differently bent OPTs can be guided to the entrance of the claw unit reliably.

In another advantageous embodiment, the at least one guiding flap element is arranged movably relative to a body of the ABT and/or a handle of the OPT and/or the OPT track. Here, the at least one guiding flap element is movable between a guiding position and a clearing position. In the guiding position, the end of the at least one guiding flap element proximal to the claw unit (the proximal end which is a narrow end in the direction of the OPT track) is forming a gate or part of a gate that guides the tip of the OPT into the entrance of the claw unit. In the clearing position, a distance of the proximal end and the OPT track is increased as compared to the guiding position. Consequently, when moved from guiding position to clearing position, the at least one guiding flap element is, at least in some part moved away from the OPT track and thus gives space to the holding unit, which thus can approach the claw unit unhindered by the tip guiding unit. So in spite of the guiding flap element, the OPT can be moved very close to the claw unit by the holding unit. This further increased the reliability of the ABT, as the OPT may be held by the holding unit for a greater part of the bundling process.

Therein, the at least one guiding flap element may be arranged rotatably around a respective rotation axis, preferably with the rotation axis running perpendicular to the OPT track and/or the rotation axis having a nonzero distance from the OPT track. So, the rotation axis preferably runs in a plane perpendicular to the OPT track. In one possible embodiment, the rotation axis is running parallel to the width direction of the respective OPT. This is particularly advantageous if the tip guiding unit comprises only one single guiding flap element, which thus can be moved away from the OPT track suit in a simple, reliable and fast way.

Alternatively, in particular in combination with the use of exactly two guiding flap elements, the respective rotation axis may be running parallel to the thickness direction of the respective ideal or straight OPT. So, where in the first alternative the at least one guiding flap element is moved away in an upper direction, the at least one, for instance two guiding elements may in the second alternative be moved away from the OPT track in a side direction. These two alternatives have proven to be particularly useful as they allow the fast clearance of the OPT track, e.g., the path of the holding unit towards the claw unit. The first alternative is the preferable one, though, as it requires less parts. Choosing one or another alternative, though, may be appropriate to adapt the system to different shapes of the holding unit.

In a further advantageous embodiment, the at least one guiding flap element is configured to be held in the guiding position by a spring element, and to be moved into the clearing position by the holding unit approaching the claw unit. In particular, the at least one guiding flap element may be configured to be moved into the clearing position by a mechanical interaction of the holding unit with the at least one guiding flap element, where the mechanical interaction may be realised by direct physical contact of the holding unit and the tip guiding unit, in particular the at least one guiding flap element, or implemented by the use of suitable mediating means like a lever or the like. This gives the advantage that the tip guiding unit does not require an individual actuator and the timing of the motion of the at least one guiding flap element can be adjusted by its mechanical design, thus independent of control programs or the like, which thus do not need to be adapted to the improved functionality of the ABT. Preferably, the holding unit and/or the tip guiding unit, in particular the at least one guiding flap element, have respective skid element configured for realising said mechanical interaction. The skid elements can be configured such that mechanical contact between the bundling tool device and the OPT is avoided. This minimises the risk of mechanical damage to the cable ties.

In another advantageous embodiment, the at least one guiding flap element is configured to be locked in the clearing position by a locking element, where the locking element is configured to release the at least one guiding flap element when a distance between the holding unit and the at least one guiding flap element exceeds a preset or predetermined distance. Therein, the locking element may be configured to release the at least one guiding flap element by means of a mechanical interaction with the holding unit meditated by suitable mediating means so, such as a lever or the like. This gives the advantage that the holding unit may be designed more independently of the at least one guiding flap element as the probability of an entanglement of the holding unit with the at least one guiding flap element is decreased.

Preferably, an inner (deflecting) surface of the at least one guiding flap element, which is a surface of the at least one guiding flap element orientated towards the OPT track, has or is a smooth surface and/or a coated surface. The orientation of surfaces may be determined as known from mathematics, that is, by the orientation of its normal vector. This further supports the guiding of the OPT strap tip towards the entrance of the claw unit, as it reduces the probability for entanglement of the OPT strap tip with the at least one guiding flap element.

Another aspect relates to a method for bundling a bundling good by means of a one-piece tie, OPT, in particular for bundling the bundling good by means of a cable tie as the one-piece tie, preferably by a loose cable tie as the one-piece tie, with an automatic bundling tool device, ABT. The method comprises the method steps of providing a respective OPT to the ABT from an external reservoir, moving the respective OPT towards the bundling good with the tip of the respective OPT ahead by a motion guiding unit and/or the holding unit, guiding, if the respective OPT has a bent strap, that is an un-voluntarily non-straight strap, the tip and, as a consequence, also the strap of the respective OPT, towards an entrance of a claw unit by at least one guiding flap element of a tip guiding unit positioned in a guiding position, moving, after the tip has entered the claw unit, the at least one guiding flap element in a clearing position further away from an OPT track than in the guiding position, and guiding the tip (and thus the strap) of the respective OPT around the bundling good and through a window in the head (part) of the respective OPT, by the claw unit.

Advantages and advantageous embodiment of the method correspond to advantages and advantageous embodiments of the automatic bundling tool device.

The features and combinations of features described above, including the general part of the description, as well as the features and combinations of features disclosed in the figure description or the figures alone may not only be used alone or in the described combination, but also with other features or without some of the disclosed features without departing the scope of the present disclosure. Consequently, embodiments that are not explicitly shown and described by the figures but that can be generated by separately combining the individual features disclosed in the FIGS. are also part of the present disclosure. Therefore, embodiments and combinations of features that do not comprise all features of an originally formulated independent claim are to be regarded as disclosed. Furthermore, embodiments and combinations of features that differ from or extend beyond the combinations of features described by the dependencies of the claims are to be regarded as disclosed.

BRIEF DESCRIPTION OF THE DRAWINGS

Example embodiments are further described in the following by means of schematic drawings.

In the figures, identical and functionally identical features have the same reference signs.

DETAILED DESCRIPTION

Figure 1:
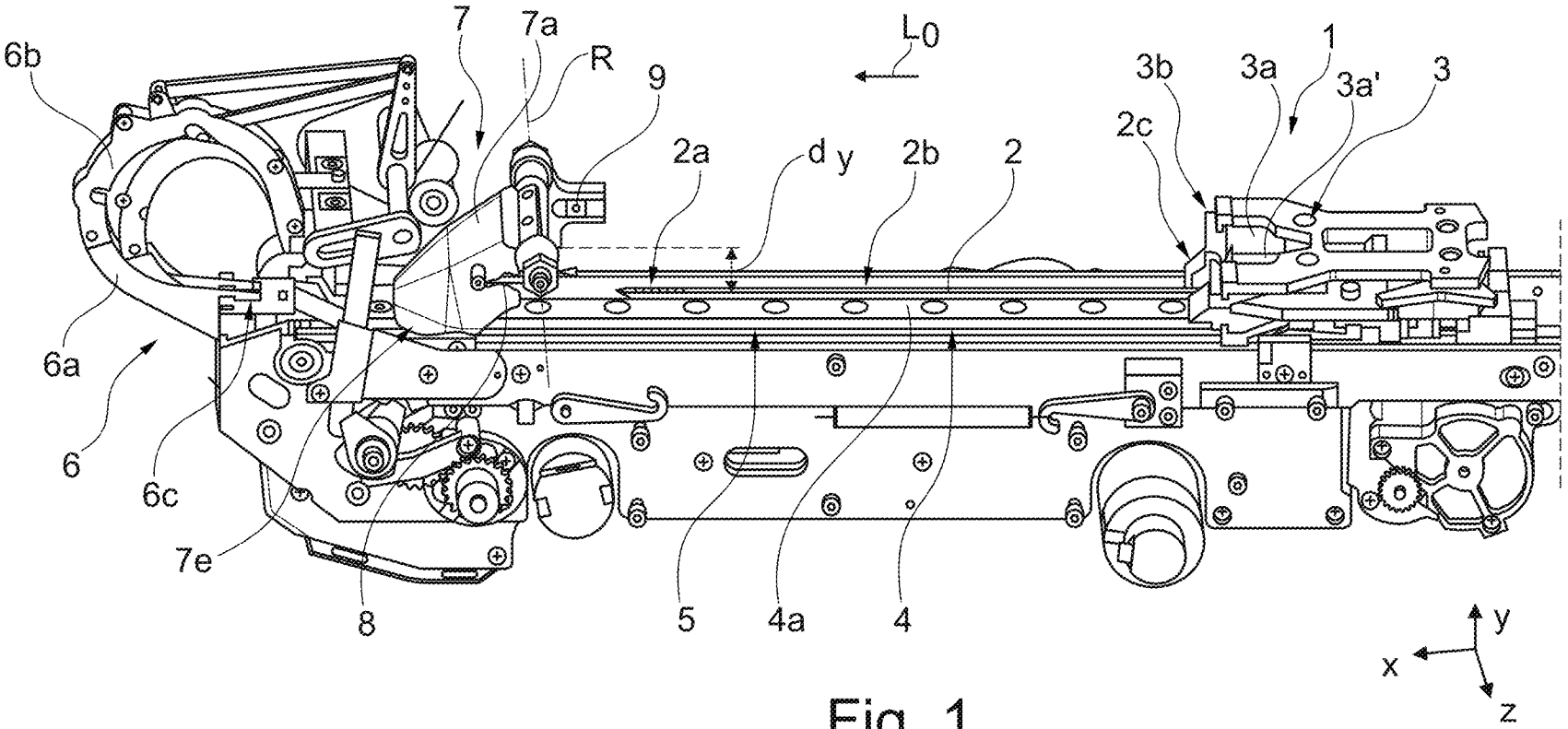
FIG. 1 shows a perspective view on an example automatic bundling tool device.

FIG. 1 shows a perspective view on an automatic bundling tool device 1, ABT 1, for bundling a bundling good by means of a one-piece tie 2, OPT 2. The one-piece tie 2 of the present example is a loose cable tie. The OPT 2 has a tip 2*a*, strap 2*b*, and a head 2*c*.

The ABT 1 further comprises a holding unit 3 configured to receive, hold, and release the respective OPT 2 which is provided to the ABT 1 from an external reservoir of OPTs. In the present example, the holding unit 3 is provided in the form of a slider on which two gripping elements 3*a* and 3*a*' are mounted. The gripping elements 3*a*, 3*a*' can be moved from an open position, in which the head 2*c* of the OPT 2 can be received to a holding position in which a contour 3*b* defined by the shapes of the individual gripping elements 3*a* and 3*a*' establishes an at least partial form fit connection to the head 2*c* of the OPT 2. In the present example, the two gripping elements 3*a* and 3*a*' can be moved linearly traversely to a forward direction LO, that is, in a z-direction, in the present figure, where the forward direction corresponds to the x-direction.

Figure 2:
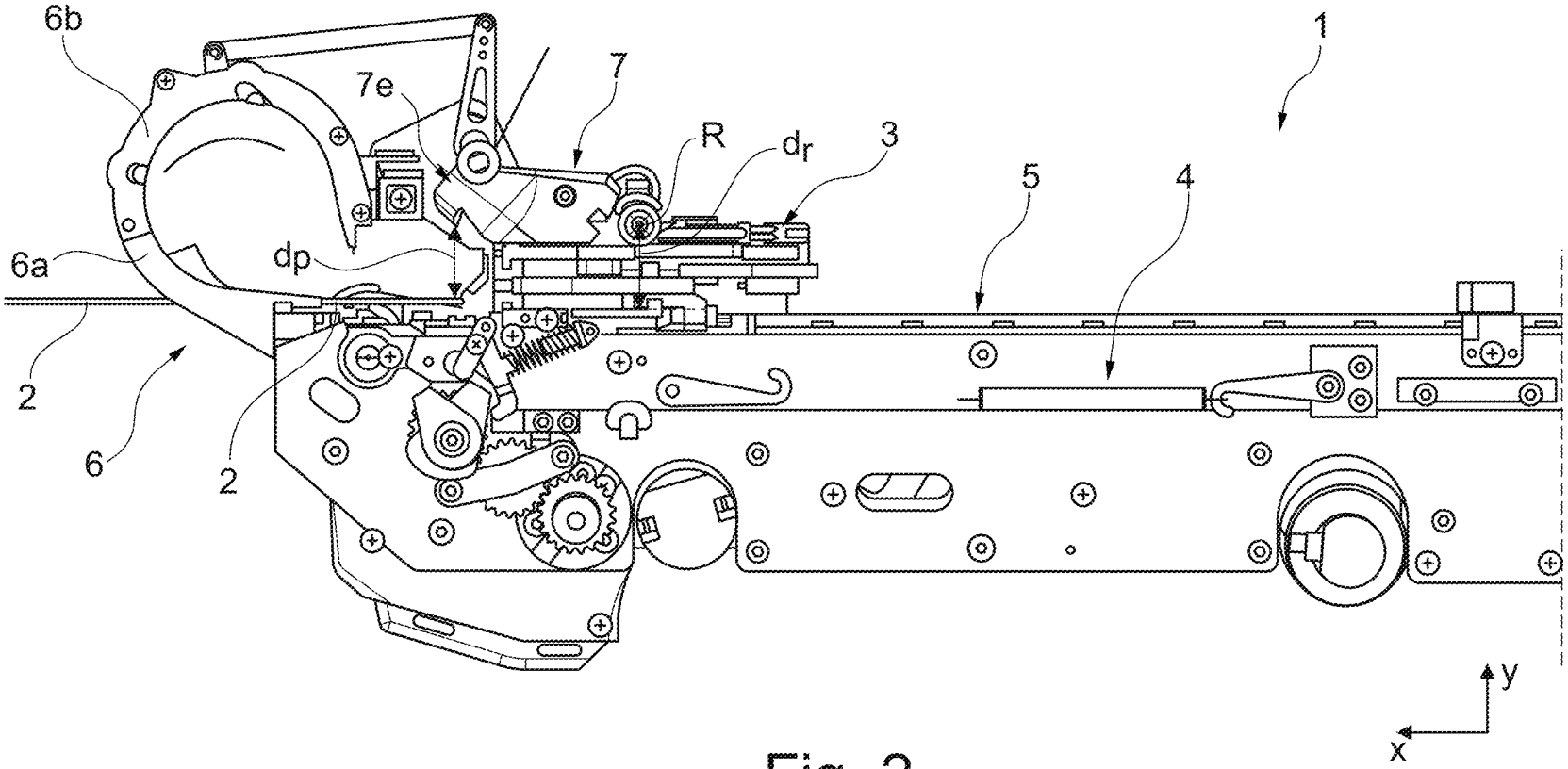
FIG. 2 shows a side view on the automatic bundling tool device of FIG. 1.

The ABT 1 further comprises a motion guiding unit 4 configured to guide a motion of the holding unit 3 between a receiving position of the holding unit 3, where the holding unit 3 receives, during intended use, the respective OPT 2 and a releasing position of the holding unit 3 where the holding unit releases, during intended use, the respective OPT 2. Note that in FIG. 1, the motion guiding unit 4 is shown in the receiving position. The motion guiding unit 4 approaching the releasing position is shown in FIG. 2. In the present example, the motion guiding unit 4 is a linear motion guiding unit 4 with a linear rail 4*a* which defines an OPT track 5.

The ABT 1 also comprises a claw unit 6 configured to guide the strap 2*b* of the respective OPT 2 around the bundling good. The present example, the claw unit 6 comprises an upper jaw as first claw element 6*a*, which is static as it is not movable with respect to a housing or handle of the ABT 1 and the motion guiding unit 4. The claw unit 6 further comprises a lower jaw as second claw element 6*b*, which can be moved, in particular, opened and closed in order to form a guide around the bundling good for the loop of the strap 2*b*.

The ABT of the present embodiment features a tip guiding unit 7 with at least one guiding flap element 7*a* configured to guide the tip 2*a*, and thus also the strap 2*b* of the respective OPT 2 towards an entrance 6*c* of the claw unit 6 when the respective OPT 2 is moved in the forward direction LO towards the releasing position of the holding unit 3 by the holding unit 3 moving from the receiving position to the releasing position.

In the present example at least one distance, here at least two distances are measured perpendicular to the OPT track 5. The first distance is measured as a y-distance in the y-direction, which is a direction of thickness of the respective OPT 2. The second distance is measured as a z-distance in a direction of width of the respective OPT 2. This is shown in detail in FIG. 3. Consequently, in the present example, the at least one guiding flap element 7*a* forms a section of a funnel narrowing towards the claw unit 6 (in the forward direction LO), where the narrow end of the funnel shapes a gate 7*d* (e.g., forms said gate 7*d* or part of it) that is configured to guide the tip 2*a* to or into the entrance 6*c* of the claw unit 6. In order to form said section of the funnel, the guiding flap element 7*a* comprises an upper inner (deflecting) surface 7*b* as well as two side inner (deflecting) surfaces 7*c*, 7*c*', with the inner side surfaces 7*c*, 7*c*' converging in the positive x-direction, that is, the forward direction LO, and the upper inner surface 7*b* converging towards the OPT track 4*a* in the same direction. This is shown in more detail in FIG. 4.

In the present example, the at least one guiding flap element 7*a* is arranged movably relative to the body of the ABT 1. It is movable between a guiding position, which is shown in FIG. 1, and a clearing position, which is shown in FIG. 2. In the guiding position, an end 7*e* of the at least one guiding flap element 7 proximal to the claw unit 6, the proximal end 7*e*, is forming said gate 7*d* or part of the gate 7*d* which guides the tip 2*a* of the OPT 2 to or into the entrance 6*c* of the claw unit 6. In the clearing position, a distance dp of the proximal end 7*e* and the OPT track 5 or, correspondingly, the OPT 2 moved along the OPT track 5 is increased as compared to the guiding position. As shown in FIG. 2, the distance dp may be increased such that holding unit 3 can move into space taken by the guiding flap element 7*a* before.

The movement of the at least one guiding flap element 7*a* can be a linear movement or, as shown in the present example, a rotational movement. Correspondingly, in the present example, the at least one guiding flap element 7*a* is arranged rotatably about the respective rotation axis R with, in the present example, the rotation axis R running traversely to the OPT track 5. It is advantageous if a distance dr of the rotation axis and the OPT track 5 is nonzero, for instance, more than at least five times or more than at least ten times the thickness of the OPTs to be processed by the ABT 1. In the present example, the rotation axis R is also running parallel to the width direction of the respective OPT 2.

An alternative solution would be to arrange two movable guiding flap elements, preferably each arranged rotatably around the respective rotation axis, with the two rotation axes running in parallel and the guiding flap elements opening up sideways, that is, in the z-direction. Although the shown embodiment comprises less movable parts, depending on the shape of the holding unit and available space, such an alternative embodiment might be chosen for the respective application at hand.

As shown the figures, the one or more rotation axes R are preferably arranged, in the x-direction, between claw unit 6 and holding unit 3 when in the holding unit 3 is in the receiving position. The figures also show that, alternatively or in addition, a part (e.g. a half, as viewed in x-direction) of the guiding flap element 7*a* comprising the proximal end 7*e* may further away from the one or more rotation axes R than another part (e.g. the other half) of the guiding flap element 7*a* comprising an end opposite (in x-direction) to the proximal end 7*e*.

In the example shown here, the at least one guiding flap element 7*a* is configured to be held in the guiding position by a spring element 8, and to be moved into the clearing position by the holding unit 3 approaching the claw unit 6, in the present example by a mechanical interaction of the holding unit 3 with the at least one guiding flap element 7*a*. Furthermore, in the example shown, the at least one guiding flap element 7*a* is configured to be locked in the clearing position by a locking element 9, which is configured to release the at least one guiding flap element 7*a* when the distance between the holding unit 3 and the at least one guiding flap element 7*a* in the forward direction, that is, in the x-direction, exceeds a preset distance when the holding unit 3 is retracted from releasing position to receiving position. The inner surfaces 7*b*, 7*c*, and 7*c*' may be smooth surfaces and/or coated surfaces.

Figure 3:
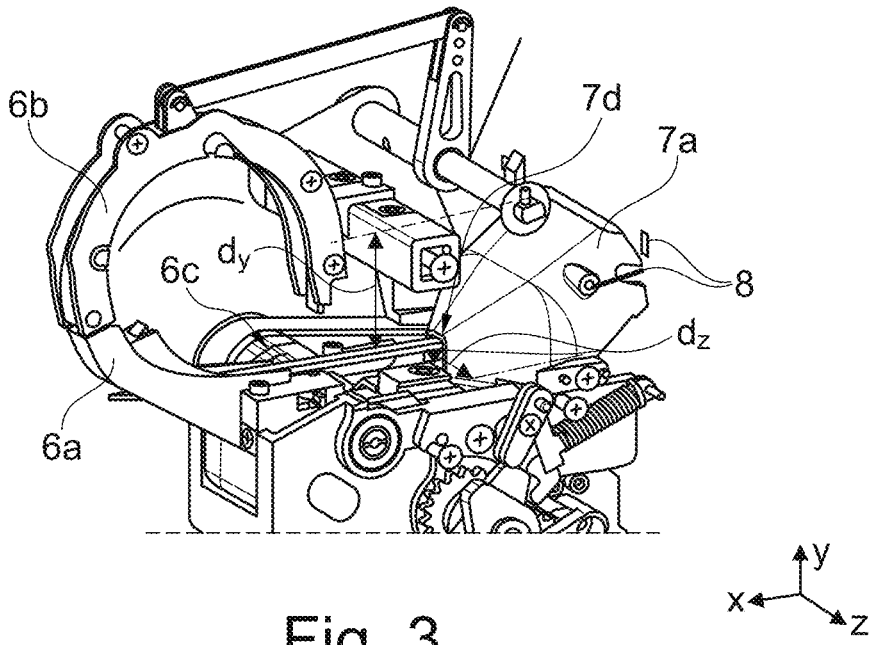
FIG. 3 shows a perspective view on a detail of the automatic bundling tool device of FIG. 1.
Figure 4:
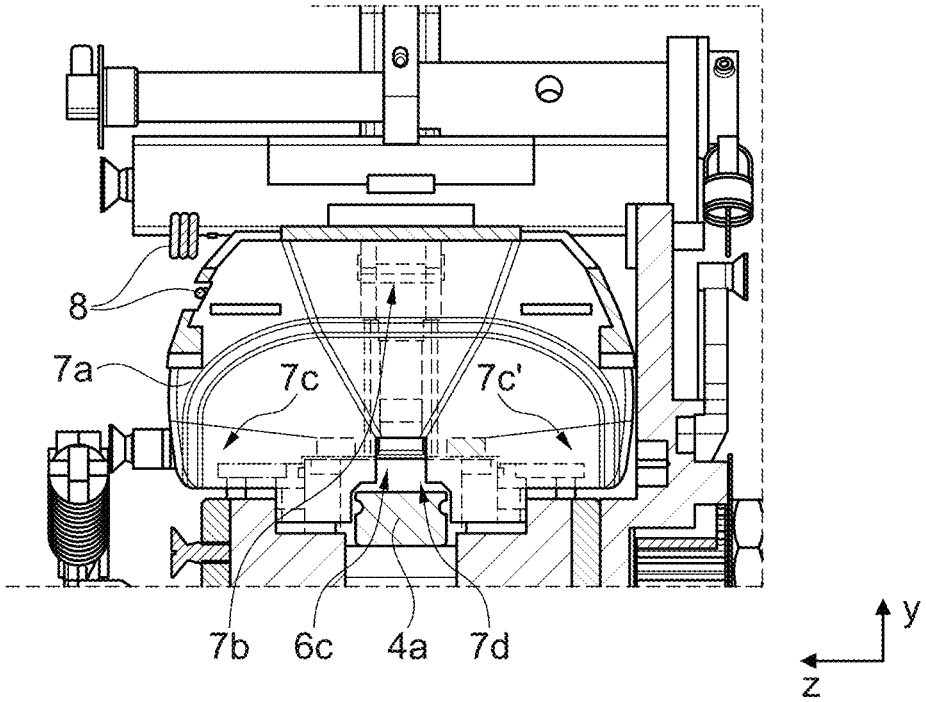
FIG. 4 shows the detail of FIG. 3 from another perspective.

Accordingly, the functioning of the ABT 1 shown here can be described by the following example method steps. First, when the holding unit 3 is in the receiving position (as shown in FIG. 1) the OPT 2 is provided to the ABT 1, from an external reservoir. The OPT 2 is fixed its position, for example by a form fit connection to the two gripping elements 3*a* and 3*a*'. Then, the respective OPT 2 can be moved towards the bundling good (not shown), with the tip 2*a* of the respective OPT 2 ahead, in the forward direction LO, which is a positive x-direction. We consider the case when the OPT 2 is not an ideal straight OPT shown in the present FIGS., but a bent OPT 2, which is an OPT 2 with an involuntary nonstraight strap 2*b* such that there is a nonzero distance between the tip 2*a* and the OPT track 5 the tip 2*a* is supposed to take in order to meet the entrance 6*c* without any additional interaction. With the respective OPT 2 having a bent strap 2*b*, the tip 2*a* and the strap 2*b* of the respective OPT 2 are guided towards the entrance 6*c* of the claw unit 6 by the at least one guiding flap 7*a* of the tip guiding unit 7 which is positioned in the guiding position (as shown in FIG. 3). Then, after the tip 2*a* has entered the claw unit 6, the guidance by the tip guiding unit 7 is no longer required. Therefore, the at least one guiding flap element 7*a* is moved in a clearing position further away from the OPT track 5 than in the guiding position (as shown in FIG. 2). As the at least one guiding flap element 7*a* is in the clearing position, the holding unit 3 can approach the entrance 6*c* of the claw unit 6 to the same extent than without the tip guiding unit 7. Consequently, the strap 2*b* is guided around the bundling good by the claw elements 6*a* and 6*b* back through head 2*c* of the respective OPT 2 by the claw unit 6, and forms a loop as usual. However, in the present example embodiment, bent OPTs, in particular loose cable ties can be processed reliably and do not lead to failure of the automatic bundling process.

Unless context dictates otherwise, use herein of the word "or" may be considered use of an "inclusive or," or a term that permits inclusion or application of one or more items that are linked by the word "or" (e.g., a phrase "A or B" may be interpreted as permitting just "A," as permitting just "B," or as permitting both "A" and "B"). Also, as used herein, a phrase referring to "at least one of" a list of items refers to any combination of those items, including single members. For instance, "at least one of a, b, or c" can cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c, or any other ordering of a, b, and c). Further, items represented in the accompanying figures and terms discussed herein may be indicative of one or more items or terms, and thus reference may be made interchangeably to single or plural forms of the items and terms in this written description.

What is claimed is:

1. An automatic bundling tool device (ABT) configured for bundling a bundling good through use of a one-piece-tie (OPT), the device comprising:

a holding unit configured to receive, hold, and release a respective OPT provided to the ABT from an external reservoir of OPTs;

a motion guiding unit configured to guide a motion of the holding unit between a receiving position of the holding unit where the holding unit receives the respective OPT and a releasing position of the holding unit where the holding unit releases the respective OPT;

a claw unit configured to guide a strap of the respective OPT around the bundling good; and a tip guiding unit with at least one guiding flap element configured to guide a tip of the respective OPT towards an entrance of the claw unit when the respective OPT is moved towards the releasing position by the holding unit moving from the receiving position to the releasing position, wherein:

at least one distance between an inner surface of the at least one guiding flap element and an OPT track along which the respective OPT is moved from the receiving position to the releasing position decreases in a direction towards the claw unit, the at least one distance is measured perpendicular to a longitudinal axis of the OPT track as a y-distance in a direction of thickness of the respective OPT and as a z-distance in a direction of width of the respective OPT, and the holding unit is configured to move the at least one guiding flap element.

2. The automatic bundling tool device of claim 1, wherein the OPT track is straight.

3. The automatic bundling tool device of claim 1, wherein the at least one guiding flap element forms a section of a funnel narrowing towards the claw unit, where a narrow end shapes a gate that is configured to guide the tip into the entrance of the claw unit.

4. The automatic bundling tool device of claim 1, wherein the at least one guiding flap element further comprises converging surfaces that enclose an angle of less than 90 degrees.

5. The automatic bundling tool device of claim 3, wherein the at least one guiding flap element is arranged movably relative to a body of the ABT, the guiding flap element movable between a guiding position and a clearing position, wherein in the guiding position an end of the at least one guiding flap element is proximal to a proximal end of the claw unit, the proximal end forms at least one of the gate or a part of the gate that guides the tip of the OPT into the entrance of the claw unit, and wherein in the clearing position a distance of the proximal end and the OPT track is increased as compared to the guiding position.

6. The automatic bundling tool device of claim 5, wherein the at least one guiding flap element is arranged rotatably around a respective rotation axis.

7. The automatic bundling tool device of claim 6, wherein the at least one guiding flap element is arranged rotatably around a respective rotation axis with at least one of the rotation axis running perpendicular to the OPT track or the rotation axis having a non-zero distance from the OPT track.

8. The automatic bundling tool device of claim 7, wherein the rotation axis runs parallel to the width direction of the respective OPT.

9. The automatic bundling tool device of claim 5, wherein the at least one guiding flap element is configured to be held in the guiding position by a spring element and is configured to be moved into the clearing position by the holding unit approaching the claw unit.

10. The automatic bundling tool device of claim 9, wherein the at least one guiding flap element is configured to be moved into the clearing position by a mechanical interaction of the holding unit with the at least one guiding flap element.

11. The automatic bundling tool device of claim 5, wherein the at least one guiding flap element is configured to be locked in the clearing position by a locking element, and wherein the locking element is configured to release the at least one guiding flap element when a distance between the holding unit and the at least one guiding flap element exceeds a preset distance.

12. The automatic bundling tool device of claim 1, wherein the inner surface of the at least one guiding flap element is orientated towards the OPT track.

13. The automatic bundling tool device of claim 12, wherein the inner surface of the at least one guiding flap element includes at least one of a smooth surface or a coated surface.

14. A method for bundling a bundling good through use of a one-piece-tie (OPT) with an automatic bundling tool device (ABT), the method comprising:

providing a respective OPT to the ABT from an external reservoir;

moving the respective OPT towards the bundling good by a holding unit with a tip of the respective OPT ahead;

if the respective OPT has a bent strap, guiding the tip of the respective OPT towards an entrance of a claw unit perpendicular to a longitudinal axis of an OPT track in a direction of a width of the respective OPT, by at least one guiding flap element positioned in a guiding position;

after the tip has entered the claw unit, moving the at least one guiding flap element in a clearing position further away from an OPT track than in the guiding position with a movement of the holding unit; and guiding a strap of the respective OPT around the bundling good and through a head of the respective OPT, by the claw unit.

* * * * *